US008225771B2

(12) United States Patent
Aso et al.

(10) Patent No.: US 8,225,771 B2
(45) Date of Patent: Jul. 24, 2012

(54) CONTROL APPARATUS AND CONTROL METHOD FOR INTERNAL COMBUSTION ENGINE

(75) Inventors: Koji Aso, Susono (JP); Hiroshi Tanaka, Susono (JP)

(73) Assignee: Toyota Jidosha Kabushiki Kaisha, Toyota-shi (JP)

( * ) Notice: Subject to any disclaimer, the term of this patent is extended or adjusted under 35 U.S.C. 154(b) by 37 days.

(21) Appl. No.: 12/986,246

(22) Filed: Jan. 7, 2011

(65) Prior Publication Data

US 2011/0174256 A1 Jul. 21, 2011

(30) Foreign Application Priority Data

Jan. 19, 2010 (JP) ..... 2010-009243

(51) Int. Cl.
*F02D 41/06* (2006.01)

(52) U.S. Cl. ..... 123/481; 123/491; 123/198 DB; 123/179.3; 123/179.4

(58) Field of Classification Search ..... 123/481, 123/491, 198 DB, 198 F, 179.3, 179.4, 179.7, 123/179.16; 701/112, 113, 103–105
See application file for complete search history.

(56) References Cited

U.S. PATENT DOCUMENTS 4,781,160 A * 11/1988 Lohr et al. ..... 123/198 F
6,158,218 A * 12/2000 Herold et al. ..... 60/609
6,925,979 B1 * 8/2005 Seitz ..... 123/179.18
7,104,235 B2 * 9/2006 Brehob et al. ..... 123/179.5

FOREIGN PATENT DOCUMENTS

JP 08338282 A 12/1996
JP 2007270767 A 10/2007

* cited by examiner

*Primary Examiner* — Hai Huynh
(74) *Attorney, Agent, or Firm* — Gifford, Krass, Sprinkle, Anderson & Citkowski, P.C.

(57) ABSTRACT

In a startup operation of an internal combustion engine, the internal combustion engine is started by supplying fuel to only a first cylinder group formed of a portion of cylinders, from among a plurality of cylinders that make up the internal combustion engine, when a startup condition of the internal combustion engine has been satisfied, and then fuel starts to be supplied to a second cylinder group formed of the remaining cylinders after the internal combustion engine has started. Meanwhile, in a stopping operation of the internal combustion engine, the internal combustion engine is stopped when a shutoff condition of the internal combustion engine is satisfied, by first stopping the supply of fuel to the second cylinder group and then stopping the supply of fuel to the first cylinder group after the supply of fuel to the second cylinder group has been stopped.

5 Claims, 5 Drawing Sheets

FIG. 3

| | #5 | #6 | #7 | #8 |
|---|---|---|---|---|
| 0 | | | | ○ |
| 90 | | | | ○ |
| 180 | | | ○ | |
| 270 | | | ○ | |
| 360 | | ○ | | |
| 450 | | ○ | | |
| 540 | ○ | | | |
| 630 | ○ | | | |

FIG. 4

FIRING ORDER

1 — 8 — 7 — 3 — 6 — 5 — 4 — 2

FIRING ORDER

1 — 8 — 4 — 3 — 6 — 5 — 7 — 2

CONTROL APPARATUS AND CONTROL METHOD FOR INTERNAL COMBUSTION ENGINE

CROSS-REFERENCE TO RELATED APPLICATIONS

This application claims priority to Japanese Patent Application No. 2010-009243 filed on Jan. 19, 2010, which is incorporated herein by reference in its entirety including the specification, drawings and abstract.

BACKGROUND OF THE INVENTION

1. Field of the Invention

The invention relates to a control apparatus and a control method for an internal combustion engine. More particularly, the invention relates to a control apparatus and a control method for a multiple cylinder internal combustion engine.

2. Description of the Related Art

Although some fuel that is injected from a fuel injection valve into an intake port in an internal combustion engine vaporizes immediately, the rest of the fuel temporarily adheres to the wall surface of the intake port. The fuel that has adhered to the intake port vaporizes from negative pressure inside the intake pipe or the heat from the wall surface of the intake port and, together with vaporized portion of the fuel that has been newly injected from the fuel injection valve, forms an air-fuel mixture. During steady operation, the amount of fuel that is injected from the fuel injection valve and adheres to the intake port is balanced with the amount of fuel adhered to the intake port that vaporizes. Therefore, the air-fuel ratio of the air-fuel mixture that forms inside the cylinder can be made to match a stoichiometric air-fuel ratio by injecting an amount of fuel that corresponds to the stoichiometric air-fuel ratio from the fuel injection valve.

Incidentally, when starting the internal combustion engine, especially during a cold start, the temperature inside the intake pipe and the temperature of the wall surface of the intake port is low, and there is no negative pressure inside the intake pipe. Moreover, not much fuel is adhered to the intake port prior to startup. As a result, a large portion of the fuel that is injected from the fuel injection valve at startup adheres to the intake port. Accordingly, in order to form an air-fuel mixture of an ignitable concentration, a larger amount of fuel must be supplied at least in the initial cycle at startup than that is supplied during steady operation after the engine has warmed up. Also, the fuel is supplied by cylinder, so with a multiple cylinder internal combustion engine that has many cylinders, a large amount of fuel is supplied sequentially to each cylinder. However, when a large amount of fuel is supplied, a corresponding large amount of unburned hydrocarbons (HC) is discharged from the cylinders to the exhaust pipe. Although a catalyst for purifying the exhaust gas is provided in the exhaust pipe, it takes a certain amount of time for the catalyst to activate (or more specifically, for the purifying ability of the catalyst to activate) at startup when the temperature of the catalyst is low. Therefore, it is desirable to suppress the discharge of unburned HC from the cylinders as much as possible at least until the catalyst is activated. Reducing unburned HC produced at startup is a major concern in vehicles that use an internal combustion engine as a source of power.

To date, various technologies have been proposed to address this concern. One such technology is described in Japanese Patent Application Publication No. 8-338282 (JP-A-8-338282) and relates to fuel supply during startup of a multiple cylinder internal combustion engine. As described in JP-A-8-338282, it is not always necessary to supply a large amount of fuel sequentially to each cylinder in order to start a multiple cylinder internal combustion engine. That is, an internal combustion engine can be started even when the supply of fuel to some of the cylinders is stopped. Starting an internal combustion engine while the supply of fuel to some of the cylinders is stopped enables the amount of unburned HC discharged at startup to be significantly reduced. The technology in JP-A-8-338282 is an invention that is based on such knowledge, and determines those cylinders to which fuel should be supplied and those cylinders to which the supply of fuel should be stopped, based on the results of a cylinder determination at startup, and then controls the fuel supply to each of the cylinders according to that determination.

However, from the viewpoint of reducing unburned HC produced at startup of the internal combustion engine, there is room for improvement with the technology described above. In a cylinder to which the supply of fuel is stopped at the beginning of startup, i.e., in a cylinder of which activation is delayed (i.e., a delay activated cylinder), the intake and the exhaust valves are not stopped but instead open and close in conjunction with the rotation of the crankshaft, just like in the cylinders to which fuel is supplied from the beginning of startup (i.e., normally activated cylinders). Therefore, in a delayed start cylinder, mere pumping is performed and only air is discharged from the cylinder into the exhaust pipe. However, this air includes unburned HC that had been adhered to the intake port and the inside wall of the cylinder and the like. As a result, with the technology in JP-A-8-338282, even though activation of some of the cylinders is delayed in order to reduce the amount of unburned HC that is discharged, a large amount of unburned HC may end up being discharged from those delay activated cylinders.

SUMMARY OF INVENTION

This invention thus provides a control apparatus and a control method capable of suppressing the discharge of unburned HC upon startup of an internal combustion engine.

A first aspect of the invention relates to a control apparatus for an internal combustion engine that includes a startup operating portion and a shutoff operating portion. The startup operating portion starts the internal combustion engine by supplying fuel to only a first cylinder group formed of a portion of cylinders, from among a plurality of cylinders that make up the internal combustion engine, when a startup condition of the internal combustion engine has been satisfied, and then starts to supply fuel to a second cylinder group formed of the remaining cylinders after the internal combustion engine has started. The shutoff operating portion stops the internal combustion engine when a shutoff condition of the internal combustion engine has been satisfied, by first stopping the supply of fuel to the second cylinder group and then stopping the supply of fuel to the first cylinder group after the supply of fuel to the second cylinder group has been stopped.

According to the first aspect of the invention, the internal combustion engine is started by supplying fuel to only the first cylinder group, which enables the total amount of supplied fuel required to start the internal combustion engine to be reduced compared to when the internal combustion engine is started by supplying fuel to all of the cylinders. Further, when stopping the internal combustion engine, the second cylinder group to which fuel is supplied after startup is stopped first. As a result, the intake ports and the insides of the cylinders in that cylinder group are scavenged, which enables the amount of residual HC to be reduced. Therefore, the discharge of residual HC from the second cylinder group during startup can be suppressed, and thus the amount of unburned HC of the entire internal combustion engine that is discharged is able to be suppressed.

In the first aspect described above, the startup operating portion may make a group of cylinders having an exhaust pipe with a relatively small surface area between the cylinders and a catalyst, from among the plurality of cylinders, the first cylinder group.

According to this structure, fuel is supplied from the beginning of startup to the group of cylinders having an exhaust pipe with a relatively small surface area between the cylinders and a catalyst. A smaller surface area of the exhaust pipe between the cylinders and the catalyst means that less exhaust heat energy will dissipate outside the system from the surface of the exhaust pipe. Therefore, with this structure, the transfer efficiency of exhaust heat energy to the catalyst is able to be increased, so the catalyst is able to be activated quickly (i.e., early on). Activating the catalyst quickly makes it possible to more effectively suppress the discharge of unburned HC outside the system.

In the first aspect described above, the shutoff operating portion may adjust a crank angle when stopping the internal combustion engine, by obtaining a crank angle at a predetermined engine speed after the supply of fuel to the second cylinder group has been stopped, selecting one cylinder in the first cylinder group according to the obtained crank angle, and supplying fuel just once to only the selected cylinder.

According to this structure, a specified cylinder or a cylinder included in a specified cylinder group can always be made an initial firing cylinder by adjusting the crank angle when the internal combustion engine stops.

A second aspect of the invention relates to a control method for an internal combustion engine, includes: starting the internal combustion engine by supplying fuel to only a first cylinder group formed of a portion of cylinders, from among a plurality of cylinders that make up the internal combustion engine, when a startup condition of the internal combustion engine has been satisfied, and then starting to supply fuel to a second cylinder group formed of the remaining cylinders after the internal combustion engine has started; and stopping the internal combustion engine when a shutoff condition of the internal combustion engine has been satisfied, by first stopping the supply of fuel to the second cylinder group and then stopping the supply of fuel to the first cylinder group after the supply of fuel to the second cylinder group has been stopped.

BRIEF DESCRIPTION OF DRAWINGS

The foregoing and further objects, features and advantages of the invention will become apparent from the following description of example embodiments with reference to the accompanying drawings, wherein like numerals are used to represent like elements and wherein:

FIG. 3 is a chart of a method for setting a specified firing cylinder in stop position control;

FIG. 4 is a view of an example of the manner in which a specified initial firing cylinder is set according to the firing order;

DETAILED DESCRIPTION OF EMBODIMENTS

A first example embodiment of the invention will now be described with reference to FIGS. 1 to 4.

Figure 1:
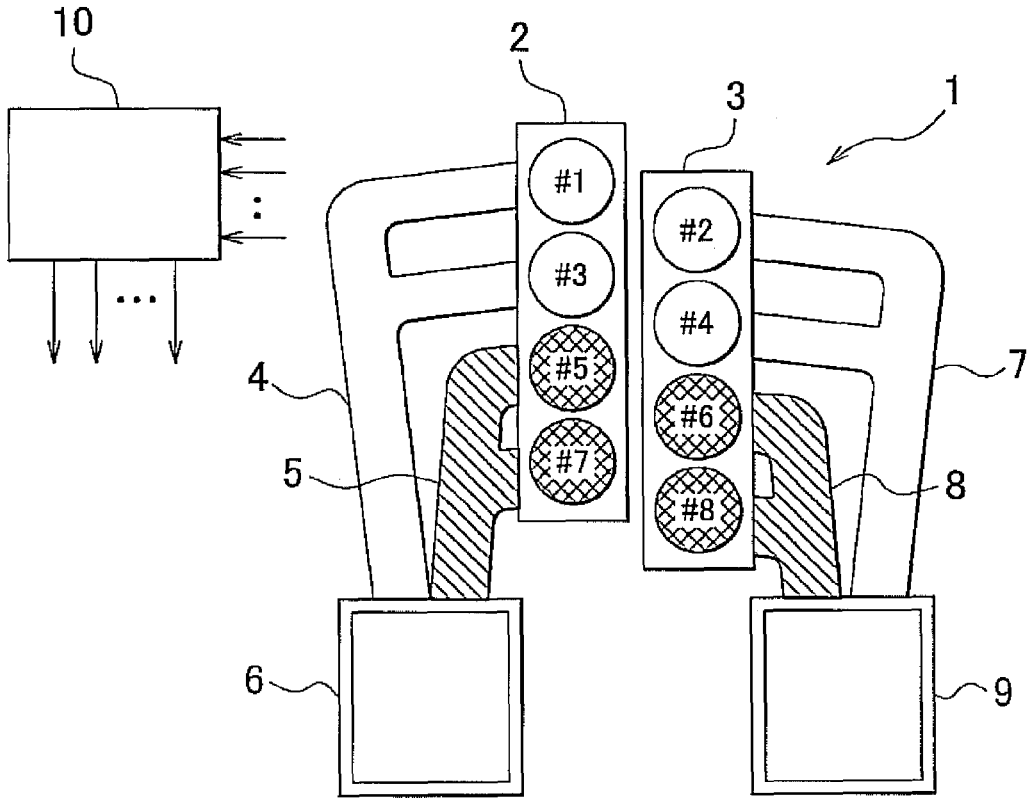
FIG. 1 is a diagram of the structure of a multiple cylinder internal combustion engine and the manner in which normally activated cylinders and delay activated cylinders are set according to a first example embodiment of the invention.

FIG. 1 is a view of the structure of a multiple cylinder internal combustion engine (hereinafter, simply referred to as "engine") to which the control apparatus of the first example embodiment may be applied. The engine 1 shown in FIG. 1 is a V-8 four-stroke reciprocating engine that has eight cylinders. The reference numbers from #1 to #8 in FIG. 1 indicate the specific cylinder number given to each cylinder. In the example shown in FIG. 1, in a left bank 2, an exhaust manifold 4 is connected to the #1 cylinder and the #3 cylinder that are located away from a catalyst 6, and an exhaust manifold 5 is connected to the #5 cylinder and the #7 cylinder that are located near the catalyst 6. The two exhaust manifolds 4 and 5 are connected in parallel to the catalyst 6. Also, in a right bank 3, an exhaust manifold 7 is connected to the #2 cylinder and the #4 cylinder that are located away from a catalyst 9, and an exhaust manifold 8 is connected to the #6 cylinder and the #8 cylinder that are located near the catalyst 9. The two exhaust manifolds 7 and 8 are connected in parallel to the catalyst 9.

The control apparatus of this first example embodiment is realized as part of a function of an electronic control unit (ECU) 10 that controls the engine 1. Startup control of the engine 1 is performed by this ECU 10 as the control apparatus. In this startup control, the ECU 10 starts the engine 1 by injecting fuel from fuel injection valves, not shown, in only some of the cylinders, instead of supplying fuel to all of the cylinders. Then after the engine 1 has started, the ECU 10 starts to inject fuel into the remaining cylinders when a predetermined condition is satisfied. Hereinafter throughout this specification, startup control that starts the engine 1 by injecting fuel into only some of the cylinders will be referred to as delayed activation control of the engine 1. Also, throughout this specification, a cylinder in which a fuel injection is performed from the first cycle at startup will be referred to as a normally activated cylinder, and a cylinder in which fuel injection starts from the second cycle after a delay from fuel injection in the normally activated cylinder will be referred to as a delay activated cylinder.

The number of cylinders set as delay activated cylinders, from among the eight cylinders of the engine 1, may be set as appropriate as long as it enables the engine 1 to start. Also, the cylinders that are set as delay activated cylinders do not have to be fixed; they may be newly set each time according to the results of a cylinder determination. However, to suppress a discharge of unburned HC at startup, it is also necessary to consider the selection of the delay activated cylinders and the normally activated cylinders because warming up of the catalysts 6 and 9 may be delayed depending on the selection.

The catalysts 6 and 9 are warmed up during a cold start by using heat energy discharged from the engine 1. Therefore, delayed activation control in which heat energy is discharged from only the normally activated cylinders is less than favorable from the viewpoint of warming up the catalysts 6 and 9.

Thus, if delayed activation control is performed, it is desirable that heat energy discharged from the normally activated cylinders be supplied to the catalysts 6 and 9 with as little waste as possible. To accomplish this, the selection of the delay activated cylinders and the normally activated cylinders is extremely important, as described above. For example, the surface area of the exhaust pipe from the #1 cylinder in FIG. 1 to the catalyst 6 is greater than it is from any other cylinder, so if the #1 cylinder is selected as a normally activated cylinder, a correspondingly larger amount of heat energy will be lost through dissipation from the wall surface. Therefore from the viewpoint of warming up the catalyst 6, it is not desirable to select the #1 cylinder as a normally activated cylinder.

Thus, in the first example embodiment, cylinders having an exhaust pipe with a relatively small surface area between them (i.e., the cylinders) and the catalyst 6 or 9 are selected as normally activated cylinders, and cylinders having an exhaust pipe with a relatively large surface area between them (i.e., the cylinders) and the catalyst 6 or 9 are selected as the delay activated cylinders. FIG. 1 is a view illustrating the manner in which the delay activated cylinders are set according to the first example embodiment. The cylinders indicated by crosshatching in FIG. 1 are normally activated cylinders, and the cylinders not indicated by crosshatching are delay activated cylinders. In FIG. 1, the #5, #6, #7, and #8 cylinders that are close to the catalysts 6 and 9 are set as the normally activated cylinders, and the #1, #2, #3, and #4 cylinders that are far from the catalysts 6 and 9 are set as the delay activated cylinders. Accordingly, the total surface area between the normally activated cylinders and the catalysts is the smallest, so the transfer efficiency of exhaust heat energy to the catalysts 6 and 9 can be increased, which enables the catalysts 6 and 9 to be warmed up quickly.

With the setting shown in FIG. 1, initial firing occurs in one of the normally activated cylinders, i.e., in one of the #5, #6, #7, or #8 cylinders. The cylinder that fires first (i.e., in which initial firing occurs) may be fixed or it may be newly selected each time according to the results of a cylinder determination. However, if a goal is to suppress the discharge of unburned HC at startup, the cylinder that fires first should be the cylinder with the least surface area between it and the catalyst. This is because the load ratio of the intake pipe during initial combustion naturally becomes higher near atmospheric pressure, so more exhaust heat energy can be obtained from the initial firing cylinder, i.e., the cylinder that fires first.

In the first example embodiment, the #7 or #8 cylinder that is closest to the catalyst 6 or 9 is set as the designated initial firing cylinder. Making either the #7 or #8 cylinder the initial firing cylinder and making the other the next firing cylinder enables the transfer efficiency of the exhaust heat energy to the catalysts 6 and 9 to be further improved. However, when a specific cylinder is designated as the initial firing cylinder, it is possible that initial firing may be delayed, causing startup to take more time. This is because the cylinder in which fuel is about to be injected first after the cylinder determination is not necessarily going to be the designated initial firing cylinder. In order to have the first cylinder after the cylinder determination be the specified initial firing cylinder, the initial crank angle when the engine 1 is started must always fall within a certain predetermined angle range $\chi°$ CA. In other words, the crank angle at the time the engine 1 is stopped must always fall within the predetermined angle range $\chi°$ CA.

Figure 2:
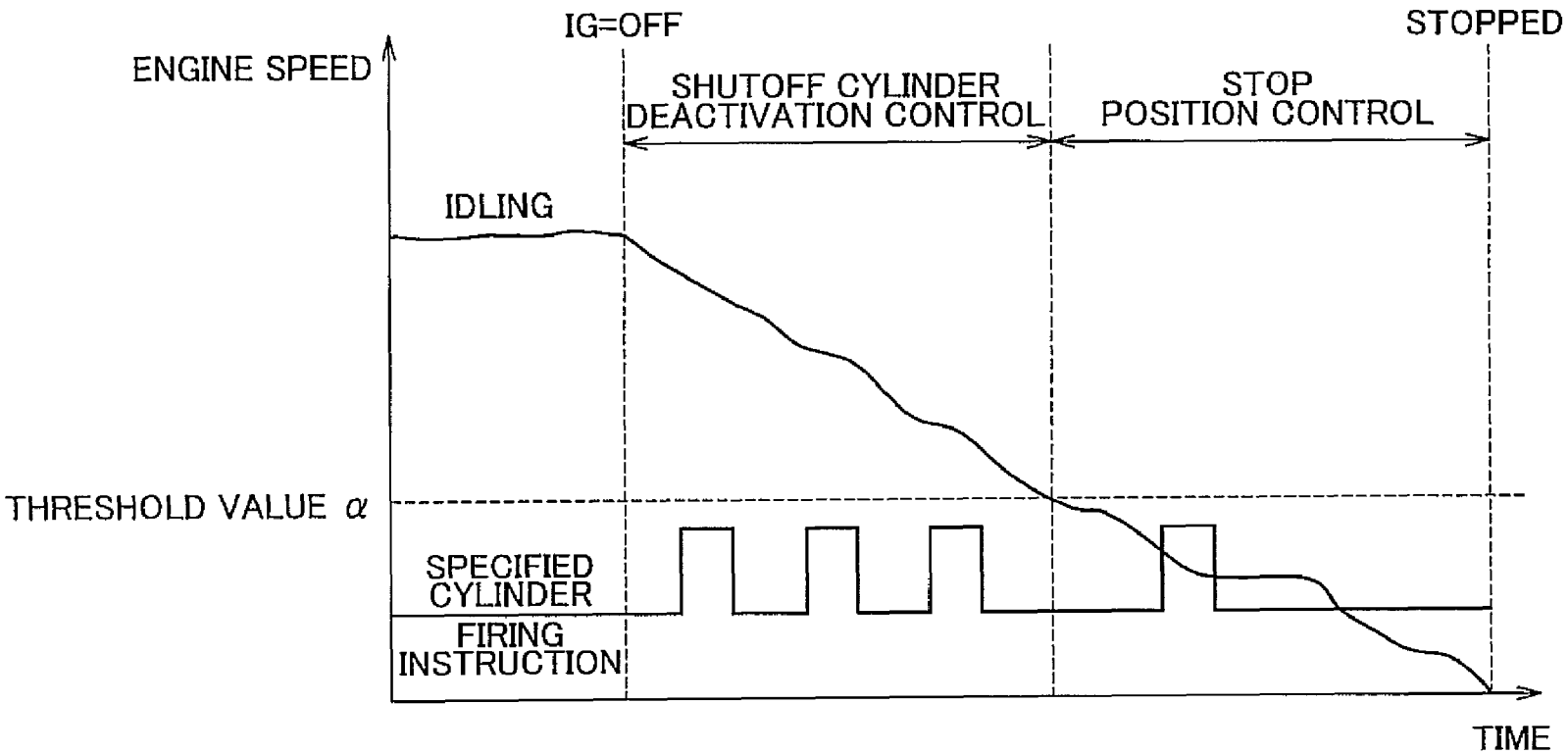
FIG. 2 is a view of shutoff cylinder deactivation control and stop position control that are performed in the first example embodiment of the invention.

In order to make the designated initial firing cylinder be the first cylinder after the cylinder determination, engine stop control that will be described with reference to FIG. 2 is performed in this first example embodiment. FIG. 2 is a graph that shows both the behavior of the engine speed until the engine 1 stops and a signal output to the engine 1 from the ECU 10. The signal shown in FIG. 2 is a signal that gives an instruction to inject fuel into specified cylinders. This signal is output after the ignition is turned off. That is, fuel injections are performed in all of the cylinders until the ignition switch is turned off, but after the ignition is turned off, a fuel injection is performed only in the cylinders specified by a signal. Hereinafter, a cylinder specified by the signal will be referred to as a specified firing cylinder.

As is evident from the waveform of the signal, according to the engine stop control of this first example embodiment, fuel injection after the ignition switch is turned off is performed in only some of the cylinders, while fuel injection in the rest of the cylinders is stopped. Then after the engine speed has decreased to a threshold value $\alpha$, a single fuel injection is performed in only a certain specified cylinder. Hereinafter, control until the engine speed falls to the threshold value $\alpha$ after the ignition has been turned off will be referred to as shutoff cylinder deactivation control, and control after the engine speed becomes equal to or less than the threshold value $\alpha$ will be referred to as stop position control in order to distinguish between the two.

First, shutoff cylinder deactivation control will be described in detail. The cylinders that are set as the specified firing cylinders in shutoff cylinder deactivation control are the normally activated cylinders. Fuel injection is stopped in the delay activated cylinders before it is stopped in the normally activated cylinders. As a result, scavenging is performed by the opening and closing operation of the intake and exhaust valves in the delay activated cylinders until the engine comes to a complete stop. This is extremely effective for suppressing the discharge of unburned HC during engine startup, as will be described next.

When performing the delay activated control described above during engine startup, scavenging is performed by idle rotation in the delay activated cylinders. If there is residual HC adhered to the intake ports or the insides of the delay activated cylinders, it will be discharged together with air into the exhaust pipe at this time. Incidentally, because the catalysts 6 and 9 do not warm up for a while when the engine is started, residual HC discharged from the delay activated cylinders as a result of scavenging will be discharged as it is into the atmosphere without being purified. That is, unburned HC ends up being discharged from the delay activated cylinders even though delayed activation control is performed to reduce unburned HC.

The shutdown cylinder deactivation control in this first example embodiment is able to suppress this from happening. That is, as a result of stopping the delay activated cylinders after scavenging has been performed, the delay activated cylinders have little or no residual HC in them when the engine 1 is started the next time. As a result, unburned HC can be suppressed from being discharged from the delay activated cylinders at startup, and thus, the amount of unburned HC discharged by the entire engine 1 can be reduced.

Next, the stop position control will be described in detail. This stop position control is control to make the crank angle when the engine 1 stops fall within the predetermined angle range $\chi°$ CA, and is control to make the designated initial firing cylinder be the first cylinder after the cylinder determination. In the stop position control, only one cylinder is set as the specified firing cylinder only once. That is, combustion is performed only once, but the stopping position of the engine 1 (i.e., the crank angle when the engine 1 stops) can be controlled by appropriately manipulating the timing of that combustion.

FIG. 3 is a chart of a method for setting the specified firing cylinder in stop position control. The horizontal axis of the chart shown in FIG. 3 represents the normally activated cylinders, and the vertical axis in the chart represents the crank angle when the engine speed reaches the threshold value α. In the stop position control of this first example embodiment, the specified firing cylinder is determined from the crank angle when the engine speed reaches the threshold value α, as shown in FIG. 3. For example, when the crank angle when the engine speed reaches the threshold value α is 540 degrees, the #5 cylinder is determined to be the specified firing cylinder, and when the crank angle when the engine speed reaches the threshold value α is 270 degrees, the #7 cylinder is determined to be the specified firing cylinder. Fuel is supplied to the specified firing cylinder after a predetermined period of time β has passed after the engine speed reaches the threshold value α. Incidentally, the values of α and β may each be determined appropriately.

FIG. 4 is a view of two firing order patterns among the cylinders. The firing order shown on top is #1, #8, #7, #3, #6, #5, #4, and #2. The firing order shown on the bottom is #1, #8, #4, #3, #6, #5, #7, and #2. In both cases, the #8 cylinder that is the designated initial firing cylinder fires first and the #7 cylinder that is the second firing cylinder fires next. Also, if fuel is unable to be injected into the #8 cylinder because the stop position is off, the initial firing cylinder is changed to the #7 cylinder and the engine 1 begins to be started by supplying fuel to the #7 cylinder. Therefore, even if the designated initial firing cylinder is unable to be made the first cylinder after the cylinder determination due to a disturbance such as engine friction or the like, the effects on the discharge of unburned HC and the time delay at startup are able to be kept to a minimum.

Next, a second example embodiment of the invention will be described with reference to FIG. 5.

Figure 5:
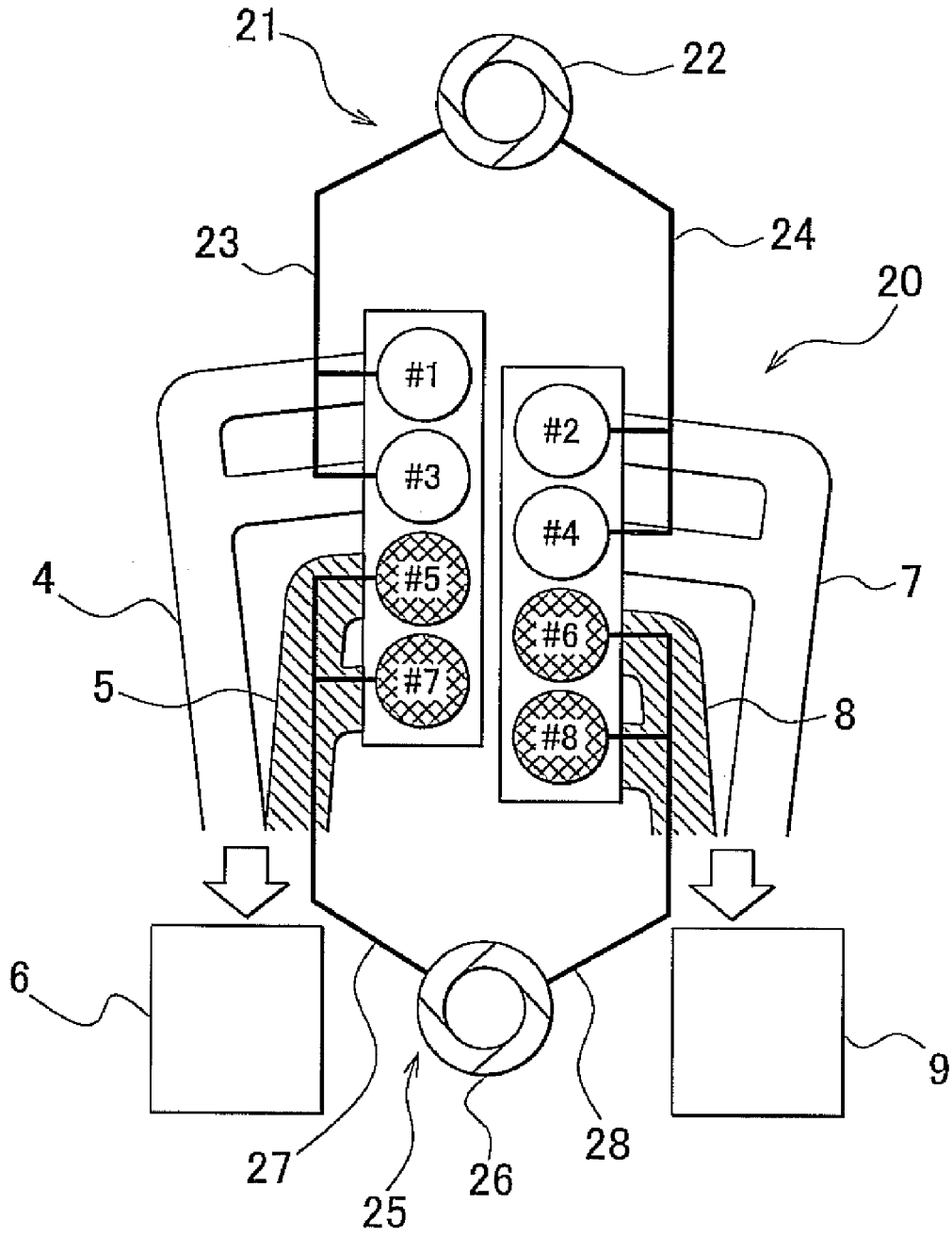
FIG. 5 is a view of the structure of a multiple cylinder internal combustion engine according to a second example embodiment of the invention.

FIG. 5 is a diagram of the structure of an engine to which a control apparatus according to the second example embodiment may be applied. The control apparatus of this second example embodiment performs delayed activation control, shutoff cylinder deactivation control, and stop position control, as controls of an engine 20, similar to the first example embodiment. These controls are the same as they are in the first example embodiment so descriptions relating thereto will be omitted.

The engine 20 in this second example embodiment differs from the engine 1 in the first example embodiment in that it includes air injection (AI) systems 21 and 25 to supply secondary air. The AI systems 21 and 25 are provided separately, one for the group of delay activated cylinders, i.e., the #1, #2, #3, and #4 cylinders, and one for the group of the normally activated cylinders, i.e., the #5, #6, #7, and #8 cylinders. The Al system 21 for the delay activated cylinder group is formed of an electric air pump (EAP) 22 and AI delivery lines 23 and 24 that connect this EAP 22 to each of the delay activated cylinders. Similarly, the AI system 25 for the normally activated cylinder group is formed of an EAP 26 and AI delivery lines 27 and 28 that connect this EAP 26 to each of the normally activated cylinders.

The reason for providing a separate AI system 21 and 25 for each of the two cylinder groups in this way is to suppress the discharge of unburned HC during engine startup. At the beginning of startup of the engine 20, exhaust gas is supplied together with heat energy from the normally activated cylinders to the catalysts 6 and 9. The secondary air that is supplied to the normally activated cylinders at this time promotes the combustion of unburned HC in the catalysts 6 and 9, thereby promoting warm-up of the catalysts 6 and 9 and also helping to suppress the discharge of unburned HC. Incidentally, when secondary air is also supplied to the delay activated cylinders in which combustion has not yet started, the low temperature secondary air ends up cooling the exhaust manifolds 4 and 7, and leads to a loss of heat energy supplied from the delay activated cylinders to the catalysts 6 and 9 after combustion starts. Therefore, in this second example embodiment, the EAP 22 of the delay activated cylinders is kept stopped until combustion in the delay activated cylinders starts. The EAP 22 starts to operate when the first combustion gas is discharged from the delay activated cylinders into the exhaust manifolds 4 and 7. Performing this kind of control reduces loss of exhaust heat energy that is supplied to the catalysts 6 and 9, and thus promotes warm-up of the catalysts 6 and 9.

Incidentally, with the structure shown in FIG. 5, the AI delivery lines are divided among the cylinder groups. In the delay activated cylinder group, the #1 and #3 cylinders share the AI delivery line 23, and the #2 and #4 cylinders share the AI delivery line 24. In the normally activated cylinder group, the #5 and #7 cylinders share the AI delivery line 27, and the #6 and #8 cylinders share the AI delivery line 28. The combination of the cylinders that share an AI delivery line is determined taking into account the firing order (i.e., 1-8-4-3-6-5-7-2) so that exhaust gas from a cylinder is not drawn in via an AI delivery line.

Next, a third example embodiment of the invention will be described with reference to FIG. 6.

Figure 6:
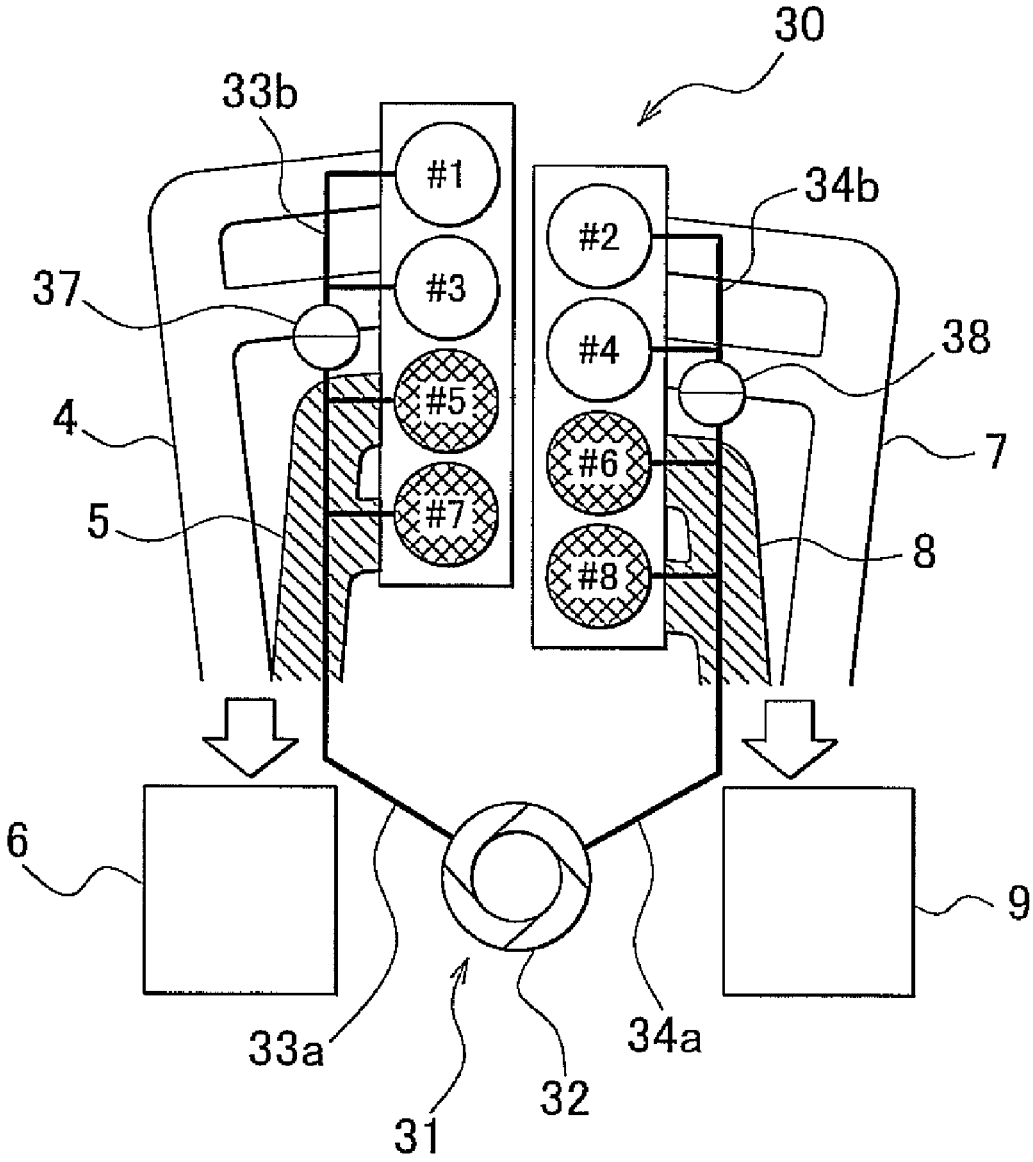
FIG. 6 is a view of the structure of a multiple cylinder internal combustion engine according to a third example embodiment of the invention.

FIG. 6 is a diagram of the structure of an engine to which a control apparatus of the third example embodiment may be applied. The control apparatus of this third example embodiment performs delayed activation control, shutoff cylinder deactivation control, and stop position control, as controls of an engine 30, similar to the first example embodiment. These controls are the same as they are in the first example embodiment so descriptions relating thereto will be omitted.

The engine 30 in this third example embodiment includes an AI system 31 for supplying secondary air, similar to the second example embodiment. However, the structure of this AI system 31 differs greatly from the structures of the AI systems 21 and 25 in the second example embodiment. The AI system 31 in this third example embodiment is formed of a single EAP 32, AI delivery lines 33*a*, 33*b*, 34*a*, and 34*b* that connect the EAP 32 to each cylinder, and regulator valves 37 and 38 that are provided midway in the AI delivery lines 33*a*, 33*b*, 34*a*, and 34*b*. The AI delivery line 33*a* and the AI delivery line 34*b* are directly connected to the EAP 32. The AT delivery line 33*a* is shared by the #5 and #7 cylinders, and the AI delivery line 34*a* is shared by the #6 and #8 cylinders. The Al delivery line 33*b* is connected to the AI delivery line 33*a* via the regulator valve 37, and the AI delivery line 34*b* is connected to the AI delivery line 34*a* via the regulator valve 38. The AI delivery line 33*b* is shared by the #1 and the #3 cylinders, and the AI delivery line 34*b* is shared by the #2 and #4 cylinders.

In this third example embodiment, when startup of the engine 30 starts, the EAP 32 starts to be operated while the regulator valves 37 and 38 are still closed. Operation of the EAP 32 results in secondary air being supplied to the normally activated cylinders, i.e., the #5, #6, #7, and #8 cylinders. However, the regulator valves 37 and 38 are closed, so secondary air is not supplied to the delay activated cylinders, i.e., the #1, #2, #3, and #4 cylinders. The regulator valves 37 and 38 remain closed until combustion starts in the delay activated cylinders. The regulator valves 37 and 38 open when the first combustion gas is discharged from the delay activated cylinders into the exhaust manifolds 4 and 7. Performing this kind of control reduces the loss of exhaust heat energy supplied to the catalysts 6 and 9, and thus promotes warm-up of the catalysts 6 and 9.

Incidentally, combustion in the delay activated cylinders starts following combustion in the normally activated cylinders and after the catalysts 6 and 9 have warmed up sufficiently by the exhaust heat energy, operation of the EAP 32 is stopped, and thus the supply of secondary air to the cylinders is stopped. Also, together with this, the regulator valves 37 and 38 are closed again. The regulator valves 37 and 38 are closed at this time to prevent exhaust gas from being drawn into the cylinders via the AI delivery lines.

While the invention has been described with reference to example embodiments thereof, it should be understood that the invention is not limited to these example embodiments. That is, the invention is intended to cover various modifications and equivalent arrangements that are within the scope of the invention. For example, in the example embodiments described above, the engine is described as being a V-type 8-cylinder engine, but the invention may of course also be applied to any engine as long as it is a multiple cylinder engine in which partial cylinder operation is possible.

What is claimed is:

1. A control apparatus for an internal combustion engine, comprising:

a startup operating portion that starts the internal combustion engine by supplying fuel to only a first cylinder group formed of a portion of cylinders, from among a plurality of cylinders that make up the internal combustion engine, when a startup condition of the internal combustion engine has been satisfied, and then starts to supply fuel to a second cylinder group formed of the remaining cylinders after the internal combustion engine has started; and a shutoff operating portion that stops the internal combustion engine when a shutoff condition of the internal combustion engine has been satisfied, by first stopping the supply of fuel to the second cylinder group and then stopping the supply of fuel to the first cylinder group after the supply of fuel to the second cylinder group has been stopped.

2. The control apparatus according to claim 1, wherein the startup operating portion makes a group of cylinders having an exhaust pipe with a relatively small surface area between the cylinders and a catalyst, from among the plurality of cylinders, the first cylinder group.

3. The control apparatus according to claim 1, wherein the shutoff operating portion adjusts a crank angle when stopping the internal combustion engine, by obtaining a crank angle at a predetermined engine speed after the supply of fuel to the second cylinder group has been stopped, selecting one cylinder in the first cylinder group according to the obtained crank angle, and supplying fuel just once to only the selected cylinder.

4. The control apparatus according to claim 1, further comprising:

a secondary air supply portion that supplies secondary air to only the first cylinder group while fuel is being supplied to only the first cylinder group during startup of the internal combustion engine.

5. A control method for an internal combustion engine, comprising:

starting the internal combustion engine by supplying fuel to only a first cylinder group formed of a portion of cylinders, from among a plurality of cylinders that make up the internal combustion engine, when a startup condition of the internal combustion engine has been satisfied, and then starting to supply fuel to a second cylinder group formed of the remaining cylinders after the internal combustion engine has started; and stopping the internal combustion engine when a shutoff condition of the internal combustion engine has been satisfied, by first stopping the supply of fuel to the second cylinder group and then stopping the supply of fuel to the first cylinder group after the supply of fuel to the second cylinder group has been stopped.

* * * * *

UNITED STATES PATENT AND TRADEMARK OFFICE

CERTIFICATE OF CORRECTION

PATENT NO. : 8,225,771 B2
APPLICATION NO. : 12/986246
DATED : July 24, 2012
INVENTOR(S) : Koji Aso et al.

It is certified that error appears in the above-identified patent and that said Letters Patent is hereby corrected as shown below:

In the Specification:

At column 1, line number 48, After by, Insert --a--

At column 7, line number 12, Delete "when the crank angle"

At column 7, line number 13, Delete "is 270", Insert --of 270--

At column 8, line number 47, Delete "AT", Insert --AI--

Signed and Sealed this
Twelfth Day of August, 2014

Michelle K. Lee

Michelle K. Lee
*Deputy Director of the United States Patent and Trademark Office*